United States Patent [19]

Patton et al.

[11] 3,968,473

[45] July 6, 1976

[54] WEIGHT-ON-DRILL-BIT AND TORQUE-MEASURING APPARATUS

[75] Inventors: Bobbie J. Patton, Dallas; Vasel R. Slover, Irving, both of Tex.

[73] Assignee: Mobil Oil Corporation, New York, N.Y.

[22] Filed: July 7, 1975.

[21] Appl. No.: 593,354

Related U.S. Application Data

[63] Continuation of Ser. No. 448,123, March 4, 1974, abandoned.

[52] U.S. Cl. ..... 340/18 LD; 340/18 NC; 175/40; 175/50

[51] Int. Cl.[2] ..... G01V 1/40

[58] Field of Search ..... 340/18 NC, 18 LD; 166/113; 175/40, 50

[56] References Cited

UNITED STATES PATENTS

| | | | |
|---|---|---|---|
| 3,813,656 | 5/1974 | Fowler | 340/18 LD |
| 3,820,063 | 6/1974 | Sexton | 340/18 NC |
| 3,906,435 | 9/1975 | Lamel et al. | 340/18 NC |

*Primary Examiner*—Nelson Moskowitz

*Attorney, Agent, or Firm*—C. A. Huggett; George W. Hager, Jr.

[57] ABSTRACT

Apparatus is provided for measuring weight and torque on the drill bit in a logging-while-drilling system. The upper end of the drill bit is adapted for slidable engagement with the lower end of the drill collar. Transducers are mounted with a cavity formed between the drill collar and drill bit when they are in slidable engagement. The transducers measure axial and rotational motions of the drill bit which represent weight and torque on the drill bit, respectively.

6 Claims, 6 Drawing Figures

WEIGHT-ON-DRILL-BIT AND TORQUE-MEASURING APPARATUS

This is a continuation of application Ser. No. 448,123, filed Mar. 4, 1974, now abandoned.

BACKGROUND OF THE INVENTION

This invention relates generally to logging-while-drilling systems and more particularly to an improved logging tool for measuring weight and torque on the drill bit during drilling operations, the measurements then being transmitted to the surface of the earth.

In one such logging-while-drilling system, the sensing apparatus located within the borehole transmits the logging measurements by means of an insulated electrical conductor extending upward to the surface of the earth through the drill collar. In another such logging-while-drilling system, the logging measurements are transmitted uphole by means of an acoustic wave passing upward through the drill collar. In yet another such system, drilling mud within the borehole is utilized as the transmission medium for the information-bearing acoustic waves. An example of such a system is disclosed in U.S. Pat. No. 3,789,355 to Bobbie J. Patton. In the Patton system, drilling mud is continuously circulated downward through the drill collar and drill bit and upward through the annulus provided by the drill collar and the borehole wall, primarily for the purpose of removing cuttings from the borehole. An acoustic transmitter located downhole continuously interrupts the flow of the drilling mud, thereby generating an acoustic signal in the drilling mud. The acoustic wave is modulated with information measured downhole by sensing apparatus, and the modulated acoustic signal is telemetered uphole to the surface of the earth through the drilling mud. At the surface, the modulated acoustic signal is detected and demodulated to provide the desired readout information.

SUMMARY OF THE INVENTION

In accordance with the present invention, a borehole drilling tool includes a weight-on-bit- and torque-measuring assembly. The lower end of the drill collar is adapted for slidable engagement with the upper end of the drill bit such that the lower end of the drill collar constrains bending motion while allowing axial and rotational motions of the upper end of the drill bit resulting from the compressional and torsional forces on the drill bit during drilling operations within a borehole.

More particularly, a hollow sleeve is connected to the lower end of the drill collar. A hollow mandrel is connected to the drill bit and is adapted for slidable insertion into the sleeve. The mandrel, when fully inserted into the sleeve, is affixed to the sleeve in such a way that bending motion of the mandrel is constrained while there remains freedom of axial and rotational motions resulting from the compressional and torsional forces transmitted to the mandrel by the drill bit during drilling operations. These compressional and torsional forces represent the weight on drill bit and torque, respectively. Transducers attached to the mandrel convert the axial and rotational motions to weight-on-drill-bit and torque measurements, respectively.

In a further aspect, the sleeve is internally threaded at its upper end and the mandrel is externally threaded at its upper end. Consequently, the upper end of the mandrel, when fully inserted into the sleeve, is in threadable engagement with the upper end of the sleeve.

In a still further aspect, a cavity is formed between the mandrel and the sleeve when the mandrel is inserted into the sleeve. At least two transducers are mounted on the mandrel within this cavity. One transducer has its sensitive axis along the axis of the mandrel and converts axial motion of the mandrel to a weight-on-drill-bit measurement. A second transducer has its sensitive axis mounted 45° with respect to the axis of the mandrel and converts rotational motion of the mandrel to a torque measurement. The pressure within the cavity is sealed from the effects of the pressure within the borehole and is equalized with the pressure within the central passageway through the mandrel.

DESCRIPTION OF THE PREFERRED EMBODIMENT

In accordance with the present invention, a weight-on-drill-bit- and torque-measuring assembly is provided in a logging-while-drilling tool to measure the compressional and torsional forces transmitted by the drill bit to the logging-while-drilling tool during drilling operations.

Figure 1:
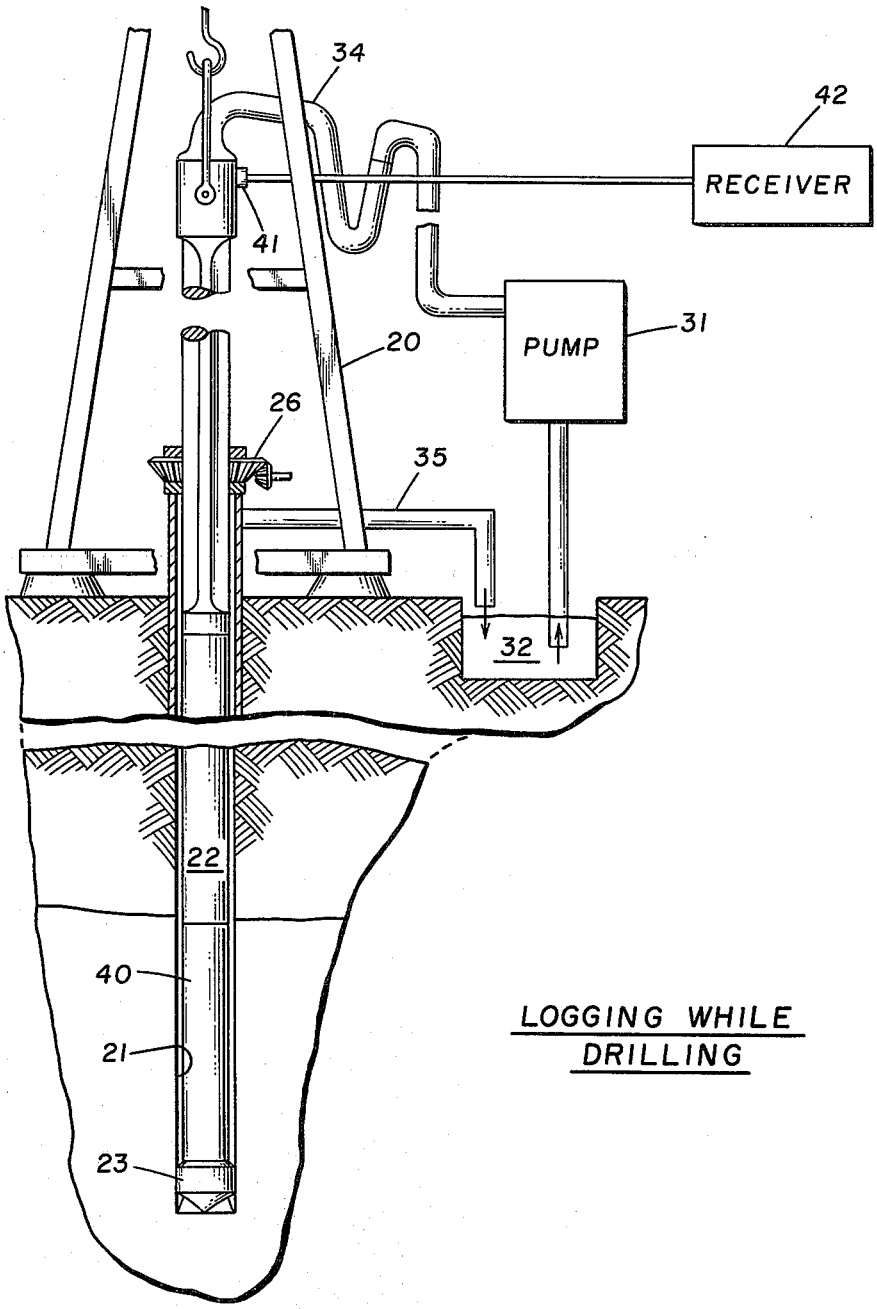
FIG. 1 illustrates a well drilling system adapted to simultaneously drill and log a well.

A brief description of a conventional rotary drilling apparatus with which the weight-on drill bit and torque-measuring assembly of the present invention can be used will be given prior to the detailed description of the weight-on-drill-bit- and torque-measuring assembly itself. In FIG. 1 there is shown a derrick 20 located over a well 21 being drilled in the earth by rotary drilling. A drill collar 22 is suspended within the well 21 and includes a drill bit 23 secured at its lower end. A suitable prime mover (not shown) drives a member 26 to rotate the drill string 22.

A pump 32 transfers drilling mud from a pit 32 in the earth into the drill collar 22. The drilling fluid then flows downward into the drill collar 22 and exits through openings in the drill bit 23 into the well 21. The drilling fluid then circulates upward from the drill bit 23, carrying formation cuttings through the annulus between the drill collar 22 and the well 21 to the surface of the earth. A pipe 35 returns the drilling mud from the well 21 to the pit 32.

Located within the drill collar 22 near the drill bit is a downhole logging tool 40 which includes one or more transducers for measuring downhole conditions and an acoustic transmitter which produces an acoustic signal in the drilling mud representative of the downhole conditions. This acoustic signal is telemetered uphole through the drilling mud where it is received by one or more transducers 41. The signals from transducers 41 are applied to a receiver 42 which provides output signals representative of the measured downhole conditions.

Figure 2:
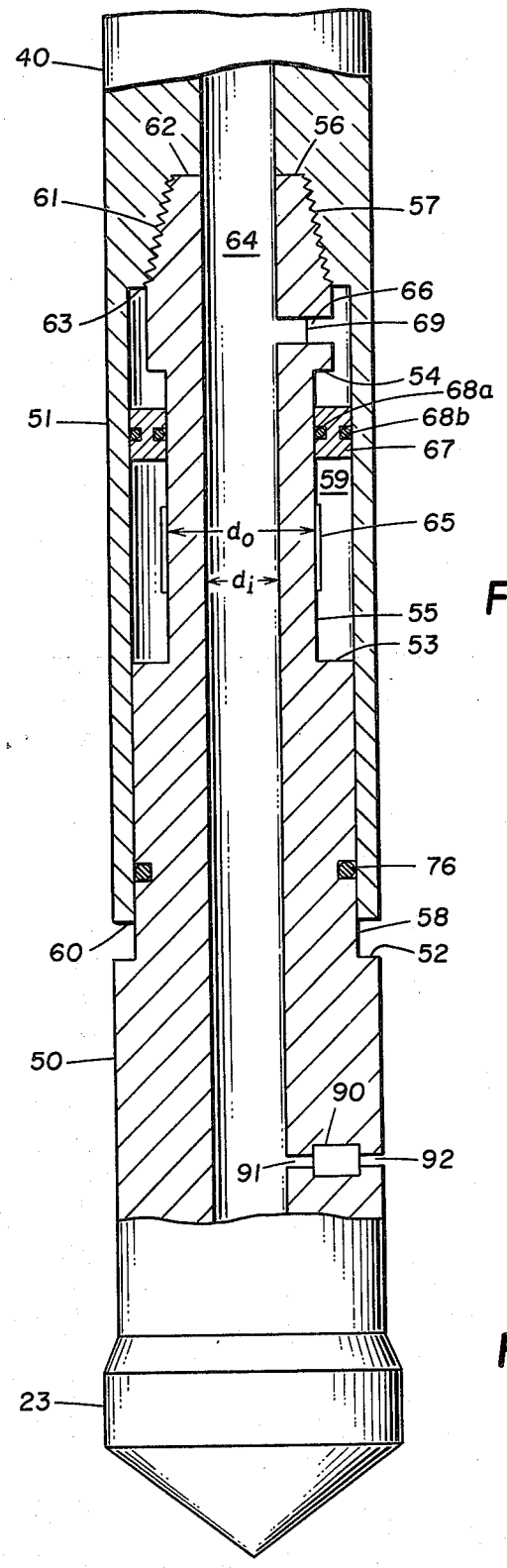
FIG. 2 is a cross-sectional view of the weight-on-drill-bit- and torque-measuring assembly of the present invention utilized with the well drilling system of FIG. 1.

Referring now to FIG. 2, there is illustrated in detail the weight-on-drill-bit- and torque-measuring assembly of the present invention which is located immediately above the drill bit 23. The assembly is comprised of the mandrel 50 and the sleeve 51.

Mandrel 50 is an extension from the drill bit 23 and is generally a hollow cylinder. The outer surface of mandrel 50 is recessed to provide for the shoulder 52 and the recessed outer surface 58. Mandrel 50 is further recessed to provide for the circumferentially slotted outer surface 55 between the shoulders 53 and 54. The end 56 of the mandrel 50 extending away from the drill bit is provided with the external threads 57.

Sleeve 51 is an extension from the downhole logging tool 40 and is also generally a hollow cylinder. The sleeve 51 is bored along its inner surface from end 60 with the bore terminating in the internal threads 61 and the shoulders 62 and 63.

To connect the mandrel 50 to the sleeve 51, the end 56 of the mandrel 50 is slidably inserted through the open end 60 of the sleeve 51 and then rotated so as to engage its external threads 57 with the internal threads 61 of sleeve 51. The bored inner surface of the sleeve 51 and the recessed outer surface 58 between the shoulders 52 and 53 of the mandrel 50 are both machined smooth to provide a bearing-type fit when the mandrel and the sleeve are completely engaged. With such a bearing fit, the sleeve constrains bending of the mandrel when the drill bit is under load during drilling operations. However, the mandrel does have the freedom of axial and rotational motions between the shoulders 52 and 54 under the compressional and torsional forces, respectively, transmitted to the mandrel by the drill bit under the load conditions of drilling operations.

Since these compressional and torsional forces are the result of the weight on the drill bit and the torque, respectively, the axial and rotational motions of the mandrel can be measured as a direct representation of such weight on drill bit and torque. Accordingly, transducers 65 are mounted on the slotted outer surface 55 of the mandrel within the cavity 59 formed between the mandrel and the sleeve for converting these axial and rotational motions into electrical signals that are connected through the central passageway 64 to the acoustic transmitter in the logging tool 40 by means of suitable electrical wiring (not shown).

Figure 3:
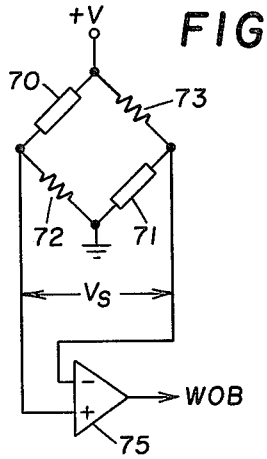
FIGS. 3–6 are schematic diagrams of the electrical components utilized with the measuring assembly of FIG. 2.

The axial motion of the mandrel may be converted to a weight-on-drill-bit strain measurement by means of at least one conventional strain gauge mounted on the slotted outer surface 55 with its sensitive axis along the axis of the mandrel to measure the strain $S_W$ in the mandrel resulting from the weight on drill bit in accordance with the following expression:

$$S_W = \frac{4W}{E\pi(d_o^2 - d_i^2)} \qquad (1)$$

where, $w$ = compressional force on the mandrel due to the weight on drill bit, $E$ = the modulus of elasticity in tension (Young's Modulus), $d_o$ = external diameter of the mandrel at the bottom of slot 55, and $d_i$ = internal diameter of the mandrel, Preferably, two strain gauges are utilized and mounted on opposite sides of the mandrel, that is, 180° removed from each other about the mandrel. As illustrated in FIG. 3, these two strain gauges are connected as opposite legs 70 and 71 of a conventional Wheatstone bridge. The two remaining legs of the bridge are formed by resistors 72 and 73. The resistors are chosen so that the bridge is balanced when the strain gauges 70 and 71 are under a no-lead or no-stress condition. That is, the voltage $V_S$ across the output of the bridge is zero.

As the weight on the drill bit is increased, there is an increase in the compressional force on the mandrel 50, causing it to move axially. The resistances of the strain gauges 70 and 71 change proportionately with this axial motion in the mandrel, thereby producing the voltage $V_S$ across the output terminals of the bridge. The voltage $V_S$ is amplified by the inverting amplifier 75 to provide for the WOB signal which is representative of the weight on the drill bit.

Similarly, the rotational motion of the mandrel may be converted to a torque strain measurement by means of at least one conventional strain gauge mounted on the slotted outer surface 55 with its sensitive axis at an angle of 45° with respect to the axis of the mandrel to measure the strain $S_T$ in the mandrel resulting from the torque in accordance with the following expression:

$$S_T = \frac{8Td_o}{G\pi(d_o^4 - d_i^4)} \qquad (2)$$

where, $T$ = torsion on the mandrel, and $G$ = the modulus of elasticity in shear, and $$G = \frac{E}{2(1+\mu)} \qquad (3)$$

where, $\mu$ = Poisson's ratio.

Figure 4:
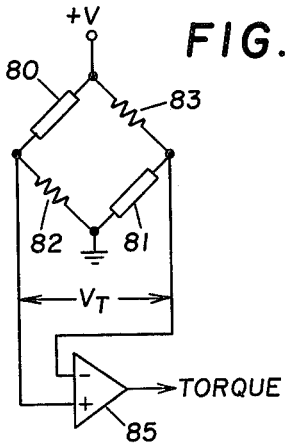

Again, it is preferable to utilize two strain gauges mounted on opposite sides of the mandrel. As illustrated in FIG. 4, these two strain gauges may be connected as opposite legs 80 and 81 of a conventional Wheatstone bridge. As the torque on the drill bit is increased, there is an increase in the torsional force on the mandrel 50, causing it to rotate. The resistances of the strain gauges change proportionately with this rotation of the mandrel, thereby producing an output voltage $V_T$ across the bridge that is representative of the torque on the drill bit.

Strain gauges for providing the $S_W$ and $S_T$ measurements are state-of-the-art components. A particularly suitable strain gauge for use in the measurement of both the compressional and torsional strains is of the foil type in which a thin film of metal is deposited on an insulator. One such strain gauge is the type EA-06-250BB-500 supplied by Micro-Measurements of Romulus, Michigan. This is a ½ inch -square strain gauge with a no-strain resistance of 500 ohms. Other types of strain gauges such as wire and semiconductor gauges may also be utilized. A suitable differential amplifier for use with the bridge is the type MC1556G supplied by Motorola.

Utilizing a nominal drill bit of 8-⅝inches , a weight-on-drill-bit distribution of 30,000 lbs. for soft rock and 60,000 lbs. for hard rock can be expected. Similarly, a torque distribution of 4,000 ft.-lbs. for soft rock to 2,000 ft.-lbs. for hard rock can be expected. Accordingly, in a preferred embodiment of the invention, the strain gauges are selected to provide for strain measurements at full-scale values of 100,000 lbs. for the weight on drill bit and 7,500 ft.-lbs. for torque. At these full-scale values, a particularly desirable strain measurement is 500 microstrains ($\mu S$). Solving Equations (1) and (2) simultaneously with the foregoing selected design criteria results in an inside diameter $d_i$ of 2 inches and an outside diameter $d_o$ of 3-¾ inches.

When operating the logging-while-drilling tool during drilling operations, pressure differentials across the weight-on-drill-bit- and torque-measuring assembly and also across the drill bit can have adverse effects on the weight-on-bit strain measurement. More particularly, a pressure differential across the mandrel from the central passageway 64 to the cavity 59 will produce forces on the mandrel 50 which cause the weight-on-bit and torque strain gauges to change resistances. A pressure differential across the drill bit due to the jet-flow of the mud through the nozzles in the drill bit produces an elongating force along the mandrel 50 that also causes the weight-on-bit and torque strain gauges to change resistances. These pressure differentials are related to the mud flow rate and, consequently, changes in the mud flow rate can cause unwanted changes in the weight-on-bit and torque strain measurements when there is actually no change in the actual weight on bit and torque.

To compensate for the unwanted effect of pressure differential across the measuring assembly, a passageway 66 is extended through the mandrel from the cavity 59 to the central passageway 64. Located in the cavity 59 between the passageway 66 and the strain gauges 65 is a pressure-equalizing piston 67. Piston 67 is circumferentially grooved to retain the O-rings 68*a* and 68*b* for sealing that portion of the cavity 59 containing the transducers 65 from the borehole fluid that enters the cavity 59 by way of the passageway 66 from the central passageway 64. The piston 67 moves between the mandrel and the sleeve and positions itself within the cavity 59 so as to equalize the pressures across that portion of the mandrel on which the strain gauges are mounted. In addition, a screen 69 is located within the passageway 66 to filter particles from the drilling fluids that could damage or adversely affect the operation of the piston 67. To seal the portion of cavity 59 containing transducers 65 from the borehole itself, the mandrel 50 is circumferentially grooved to retain the O-ring 76. O-ring 76 seals cavity 59 from the borehole liquid and borehole pressure but still permits the freedom of axial and rotational motions of the mandrel 50 within sleeve 51 along the surface 58.

to compensate for the unwanted effect of the pressure differential across the drill bit, a differential pressure transducer 90 is located within the mandrel 50 above the drill bit. The pressure within the central passageway 64 is applied to transducer 90 through the channel 91, while the pressure in the borehole outside the drill bit is applied to the transducer 90 through the channel 92. Transducer 90 produces a $\Delta P$ signal which represents this pressure differential. Suitable electrical wiring (not shown) connects the $\Delta P$ signal through the central passageway 64 to the acoustic transmitter in the logging tool 40. This $\Delta P$ signal is utilized by the circuitry of FIG. 5 to correct the WOB signal and by the circuitry of FIG. 6 to correct the TORQUE signal. A suitable differential pressure transducer for use as the transducer 90 is of the Type HHD manufactured by Baldwin-Lima-Hamilton Corporation, Waltham, Massachusetts.

Figure 5:
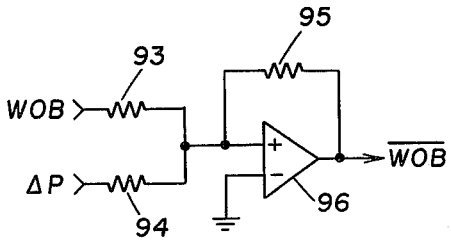

Referring to FIG. 5, both the WOB signal and the $\Delta P$ signal are applied to the positive input of amplifier 96 by way of resistors 93 and 94, respectively.

Figure 6:
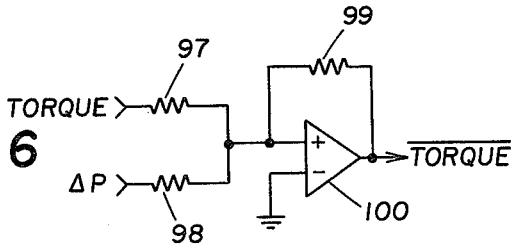

Referring to FIG. 6, both the TORQUE and $\Delta P$ signals are applied to the positive input of amplifier 100 by way of resistors 97 and 98, respectively. The polarity of the $\Delta P$ signal is chosen such that it properly compensates both the WOB signal and the TORQUE signal. Prior to operating the tool in a logging-while-drilling operation, the mud flow rate through the tool is varied and the resistance of resistances 94 and 98 selected such that there is no change in the WOB signal output of the amplifier 96 or in the TORQUE signal output of the amplifier 100. Consequently, the $\overline{WOB}$ signal and the $\overline{TORQUE}$ signal represent the actual weight on bit and torque, respectively, compensated for the unwanted effects of pressure differentials in the system during logging-while-drilling operations.

The foregoing relates to only a preferred embodiment of the invention. Obviously, many modifications and variations of the present invention are possible in light of the above teachings without departing from the spirit and scope of the invention as set forth in the appended claims. For example, various means may be utilized for converting the axial and rotational motions of the mandrel into weight-on-drill-bit and torque measurements, respectively. Likewise, various means may be utilized for correcting the weight-on-drill-bit and torque measurements for the unwanted effects caused by pressure differentials within the system.

We claim:

1. A logging-while-drilling tool comprising:

a. a drill collar, b. means for affixing a drill bit to the lower end of said drill collar, c. means for converting axial motion transmitted to said drill collar by said drill bit during drilling operations within a borehole to a weight-on-drill-bit measurement, d. means for detecting the pressure differential across said drill bit, and e. means for compensating said weight-on-drill-bit strain measurement for the effect on said measurement caused by said pressure differential across the drill bit.

2. The logging-while-drilling tool of claim 1 wherein the lower end of said drill collar includes:

a. a hollow sleeve having an upper end affixed to the lower end of said drill collar, b. a hollow mandrel having a lower end adapted to be affixed to said drill bit and having an upper end adapted for slidable insertion into said sleeve, the upper end of said mandrel being affixed to the upper end of said sleeve, whereby said sleeve constrains bending motion of said mandrel while allowing axial and rotational motions resulting from the axial and rotational forces transmitted to said mandrel by said drill bit during drilling operations within a borehole, and c. a cavity formed between a portion of said mandrel and said sleeve when said mandrel is inserted within said sleeve, said means for converting axial and rotational motions to weight-on-drill-bit and torque measurements being mounted within said cavity.

3. The logging-while-drilling tool of claim 2 wherein the internal diameter of the mandrel and the external diameter of the mandrel at the bottom of said cavity are selected such that said means for providing weight on drill bit and torque measurements provide for desirable strain measurements at predetermined values of both the weight on bit and torque.

4. The logging-while-drilling tool of claim 3 wherein said cavity is a circumferential slot formed within the outer surface of said mandrel.

5. The logging-while-drilling tool of claim 1 further including:

a. means for converting rotational motion transmitted to said drill collar by said drill bit during drilling operations within a borehole to a torque measurement, b. means for detecting the pressure differential across said drill bit during drilling operations, and c. means for compensating said torque measurement for the effect on said measurement of said pressure differential.

6. A weight-on-drill-bit- and torque-measuring assembly for a borehole drilling tool having a drill bit affixed to the lower end of a drill collar, comprising:

a. means for constraining bending motion of the drill collar while allowing axial and rotational motions resulting from compressional and torsional forces transmitted to the drill collar by the drill bit during drilling operations, b. means for converting said axial motion to a weight-on-drill-bit measurement, c. means for converting said rotational motion to a torque measurement, d. means for detecting the pressure differential across the drill bit, e. means for compensating said weight-on-drill-bit measurement for the effect on said measurement caused by said pressure differential across the drill bit, and f. means for compensating said torque measurement for the effect on said measurement caused by said pressure differential across the drill bit.

* * * * *